US005566574A

United States Patent [19]

Tiziano

[11] Patent Number: 5,566,574

[45] Date of Patent: Oct. 22, 1996

[54] METHOD AND DEVICE FOR MONITORING AND MAINTAINING CORRECT REGULATION OF THE TENSION OF A YARN FED TO A TEXTILE MACHINE

[75] Inventor: Barea Tiziano, Busto Arsizio, Italy

[73] Assignee: International Trading S.r.L., Busto Arsizio, Italy

[21] Appl. No.: 217,507

[22] Filed: Mar. 24, 1994

[30] Foreign Application Priority Data

Apr. 5, 1993 [IT] Italy ..... M193A0671

[51] Int. Cl.[6] ..... G01L 5/00

[52] U.S. Cl. ..... 73/862.473; 73/160

[58] Field of Search ..... 73/862.472, 862.42, 73/862.46, 862.393, 862.473; 364/470; 242/419.1, 147 R

[56] References Cited

U.S. PATENT DOCUMENTS

| | | | |
|---|---|---|---|
| 4,666,096 | 5/1987 | Heel et al. | 242/419.1 |
| 4,880,175 | 11/1989 | Yamauchi et al. | 242/419.1 |
| 5,056,734 | 10/1991 | Uchida et al. | 242/147 R |
| 5,329,822 | 7/1994 | Hartel et al. | 73/862.391 |

FOREIGN PATENT DOCUMENTS

| | | |
|---|---|---|
| 0305811 | 3/1989 | European Pat. Off. . |
| 0378870 | 7/1990 | European Pat. Off. . |
| 3734471 | 4/1988 | Germany . |
| 3812449 | 11/1988 | Germany . |
| 3904065 | 8/1989 | Germany . |
| 9306278 | 4/1993 | WIPO . |

*Primary Examiner*—Richard Chilcot
*Assistant Examiner*—Ronald Biegel
*Attorney, Agent, or Firm*—Steinberg, Raskin & Davidson, P.C.

[57] ABSTRACT

A method for monitoring and maintaining correct regulation of the tension of a yarn fed to a textile machine, such as a loom, a hosiery machine or a knitting machine, including the steps of continuously determining both the state of movement and the tension of the yarn at a point between a support bobbin from which the yarn is unwound and the textile machine which processes it, comparing the measured tension with a predetermined desired tension and adjusting the tension of the yarn at a point between the bobbin and the point in which the tension is measured. The tension adjustment is interrupted when the measured tension is equal to the desired value. The device of the present invention includes sensing elements for sensing movement and measuring tension of the yarn and a comparison element for comparing the measured tension value with a desired tension and which is connected to the sensing element. The comparison element cooperates with an element for controlling the braking of the yarn so as to vary the tension of the yarn in the desired manner.

21 Claims, 3 Drawing Sheets

METHOD AND DEVICE FOR MONITORING AND MAINTAINING CORRECT REGULATION OF THE TENSION OF A YARN FED TO A TEXTILE MACHINE

BACKGROUND OF THE INVENTION

The present invention relates to a method for monitoring the tension of a yarn fed to a textile machine and for regulating the feed of the yarn in such a manner as to maintain a constant feed, i.e., equal to a predetermined tension. The yarn is unwound from a usual support, such as a bobbin or the like, and is fed to the machine, such as a conventional loom, a hosiery machine or a knitting machine.

The present invention also relates to a device for implementing the method.

Methods and devices are already known for varying the tension of yarn fed to a textile machine in accordance with particular processing stages of the machine or particular requirements of the user.

A conventional tensioning device typically comprises two opposing disc elements which are pressed together and against an interposed yarn by a helical spring; the action of the spring on the discs is adjusted by a knob which is screwed onto a threaded rod to vary the pressure exerted by the discs on the yarn. In this manner, the yarn is braked and its tension varied.

Another known device comprises a series of fixed pins arranged in such a manner as to compel the yarn to travel over them and undergo a zig-zag path enabling the yarn to be braked or tensioned, By varying the relative spatial position of the pins, the path angles can be varied discretely, thereby adjusting the tension applied to the yarn.

These devices and their adjustment methods, together with other known devices and methods, enable the yarn to undergo the required tensioning or braking, but do not enable this tension to be maintained constant with time.

This tension varies during the use of the yarn even if it originates from a single support member or bobbin. In this respect, the yarn of each bobbin has a starting tension or braking which varies depending on the yarn color, its type, its lubrication and the relative humidity of the environment in which the yarn is processed, but in particular on the bobbin diameter. The yarn bobbin diameter is known to gradually decrease as the yarn is unwound from the bobbin. Hence, the rotational speed under which the yarn is unwound increases in a manner inversely proportional to the bobbin diameter, thus increasing the yarn tension. In addition, if the speed of the textile machine increases there is a proportional increase in the tension applied to the yarn.

The aforesaid conventional devices are unable to independently compensate for the continuous variation in the tension of the yarn during its use in the production of an article.

All this results in various processing problems in textile machines, which affect product quality in addition to resulting in a wastage of yarn used in producing the article. In particular, in knitting and hosiery machines, because of the non-uniformity of the yarn tension, articles are produced without a constant length or width. This makes it difficult to maintain a given size to be produced. In addition, in the case of hosiery this makes it necessary to carry out a final control of the product (matching) consisting of grouping together stockings of a fairly similar length to form suitable pairs. This results in evident high production costs to be added to the excessive use of yarn. In this respect, an article longer or wider than required obviously uses a wasted quantity of additional yarn.

The aforesaid known devices and methods are also unable to independently and automatically compensate for the tension variation. Consequently, in an attempt to maintain yarn tension variations within acceptable limits, operators or users of textile machines are compelled to continuously control the yarn fed to these machines in the sense of continuously measuring its tension and acting on braking devices to control them in such a manner so as to return the tension to within a range of acceptable values.

OBJECTS AND SUMMARY OF THE INVENTION

Accordingly, it is an object of the present invention to provide a method and relative device for monitoring and maintaining correct regulation of the tension to which the yarn is subjected during its feed to a textile machine, and in particular for maintaining this tension substantially constant or at least close to a desired value.

A further object of the present invention is to provide a method and related device for halting the textile machine when, because of a defect in the yarn bobbin or because of hindrance to the free running of the yarn, the yarn assumes an unwinding tension even slightly greater than the desired value.

Another object of the present invention is to provide a device which enables the tension of the yarn fed to the textile machine to be constantly displayed, so providing the user or operator with immediate information regarding the tension of the yarn or of each yarn fed to the machine.

Still another object of the present invention is to provide a device which senses whether the yarn is running or not running on the basis of the instantaneous variations in the yarn tension, and which device halts the machine and activates a machine alarm signal if the yarn under control is broken or missing.

Yet another object of the present invention is to provide a device which enables the yarn tension to be easily varied on the basis of processing needs, for example to achieve in sock or knitwork production a narrowing of the stitch at desired points such as the ankle or rib of socks, so enabling the shape of the article to be modelled at will.

A further object of the present invention is to provide a device for monitoring and maintaining a correct and desired yarn tension or braking which is free from maintenance or cleaning problems.

It is yet another object of the present invention to provide a device of simple and economical construction, which is of extremely compact size and can be easily used in any type of textile machine.

These objects, and others, are achieved by the method in accordance with the present invention for monitoring tension of a yarn unwound from a support bobbin and fed to a textile machine and for maintaining the tension of the yarn substantially constant and equal to a predetermined tension value, which includes the steps of determining whether the yarn is moving between the bobbin and the textile machine at a position between the bobbin and the textile machine, measuring the tension of the yarn, comparing the measured tension of the yarn to the predetermined tension value, and adjusting the tension of the yarn at a position between the bobbin and the position in which the tension is measured if the measured tension is different than the predetermined tension to cause the tension of the yarn to substantially equal the predetermined tension value. The determination of whether the yarn is moving can be made by ascertaining a variation in the measured tension of the yarn.

In preferred embodiments, a number of measured tensions at different times can be averaged and the average tension compared to the predetermined tension value. A preset peak tension value for the yarn can be provided and the measured tension compared to this preset peak tension. Irregularities and differences are detected between the measured tension and the predetermined tension value so that the textile machine can be halted when at least one irregularity is detected between the measured tension and the predetermined tension. The number of consecutive detected differences between the measured tension and the predetermined tension value can be counted and the textile machine halted when the number of consecutive detected differences equals a preset value. Also, the number of successive adjustments of the tension of the yarn can be counted, and the textile machine halted if the measured tension of the yarn after a predetermined number of successive adjustments does not equal the predetermined tension value.

The device for monitoring tension of a yarn unwound from a support bobbin and fed to a textile machine and for maintaining the tension of the yarn substantially constant and equal to a predetermined tension value of the present invention comprises movement sensing means for sensing movement of a yarn, tension measuring means for measuring tension of the yarn, comparison means coupled to the tension measuring means for determining a difference between the measured tension and the predetermined tension value, control means coupled to the comparison means, and braking means coupled to the control means for adjusting the tension of the yarn. The control means control the adjustment of the tension of the yarn via the braking means as a function of the difference between the measured tension and the predetermined tension value determined by the comparison means to cause the tension of the yarn to substantially equal the predetermined tension value. The sensing means and tension measuring means are positioned between the bobbin and the textile machine and may consist of a single sensor, at least one extensometer, or at least one piezoresistor. The comparison means and the control means may constitute a single control unit which is connected to the textile machine and controls stoppage of the textile machine on the basis of the difference between the measured tension and the predetermined tension. The device may also include acoustic and/or visual indication means connected to the control unit.

The control unit may be connected to a plurality of sensing means and measuring means, each of which cooperates with a corresponding yarn being fed to the textile machine. The control unit includes means for controlling the operation and production of the textile machine.

In one embodiment, the braking means comprise a fork-shaped element having a support element, arms connected to the support element, and an actuator having an output shaft for transferring motive force. The arms project in a perpendicular direction from the support element so that the yarn is passed between the arms such that upon rotation of the support elements, the tension of the yarn varies. The output shaft is connected to the support element and the actuator is coupled to the control means. The actuator is selected from the group consisting of an electrical actuator, a hydraulic actuator, a pneumatic actuator, a magnetic actuator, an electric motor.

In another embodiment, the sensing means, measuring means and braking means are arranged on a single one-piece body comprising a yarn guide for directing the yarn towards the sensing means and the braking means.

The braking means may comprise first and second opposing discs, a shaft passing through the discs, a shoulder arranged on one end of the shaft and against which the first disc rests, and a compression spring arranged on the shaft to press the second disc against the first disc to thereby clamp the yarn between the first and second discs and adjust the tension of the yarn. An actuator member is coupled to the control means and moves a pusher element, slidable along the shaft in contact with the spring, to vary the compression of the spring.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
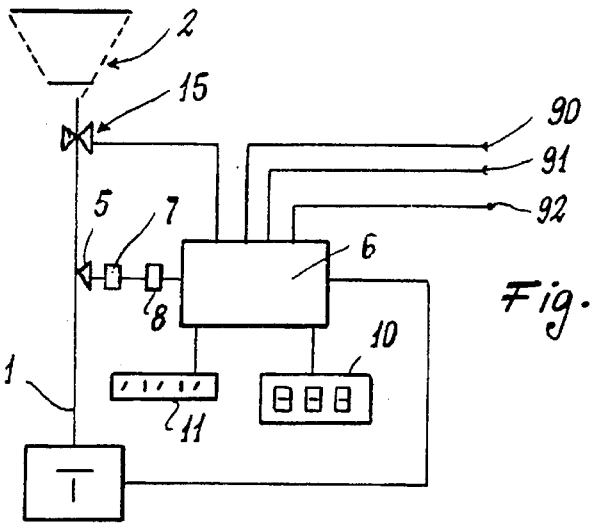
FIG. 1 is a block scheme of the device according to the invention.

With reference to FIGS. 1 to 4, the device according to the present invention operates on a yarn 1 fed from a bobbin 2 in any known manner to a textile machine T, such as a loom or a hosiery or knitting machine. The yarn 1 cooperates with a tension sensor 5, preferably a known extensometer which provides an electrical signal proportional to the tension of the yarn with which it cooperates. This sensor can also be a usual piezoresistor or the like (which, as in the case of the extensometer, can be used to form static load cells as utilized in usual weighing devices) or known pressure sensors. An extensometer, or strainometer, is an instrument used to measure minute deformations in a test specimen of a material.

Sensor 5 (positioned between the bobbin 2 and the machine T) is connected to a comparison and control unit 6 via an amplifier 7 for the signal emitted by the sensor 5 and an analog/digital converter 8 which arranges the signal for acceptance by the unit 6. The control unit 6 is preferably a microprocessor. However, the control unit may be in the form of conventional electrical and/or electronic components defining a circuit able to detect and treat analog signals, in which case the converter 8 is not used.

The comparison and control unit is connected to a display 10 for displaying the tension of the yarn under control, and to an interface 11 (such as a keyboard) enabling reference data to be fed to the unit. This data is preferably: a) data concerning a desired yarn tension value; b) data concerning the acceptable tolerance on the desired value; and c) data concerning an acceptable instantaneous peak tension value. By means of the display 10, the unit 6 continuously displays the tension of the yarn 1 during its feed to the machine T and provides the user or operator with real time information about the yarn tension.

Obviously, if the machine T operates on more than one yarn (such as a stocking production machine) each sensor 5 is connected to the unit 6 which, by means of the display, informs the user of the tension of each yarn. This can be achieved for example by providing a display which displays the tension of all yarns simultaneously, or by providing a display which shows the tension of all yarns in a cyclic and sequential manner.

The control unit 6 is connected to a braking member 15 operating on a corresponding yarn directed towards the machine T. Braking member 15 is able to vary the yarn tension (or braking). By means of the member 15 (positioned as shown in FIG. 1 between the bobbin 2 and sensor 5) the unit 6 is therefore able to vary the tension in the yarn 1 whenever the information obtained by the corresponding sensor 5 deviates from the desired value to the extent it falls outside the acceptable tolerance range.

Figure 2:
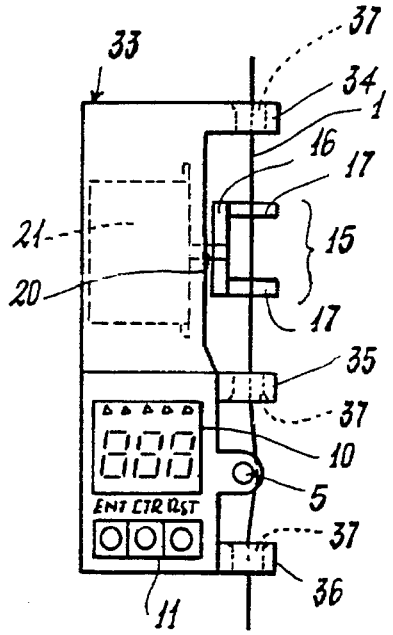
FIG. 2 is a side view of an embodiment of the device of FIG.
Figure 3:
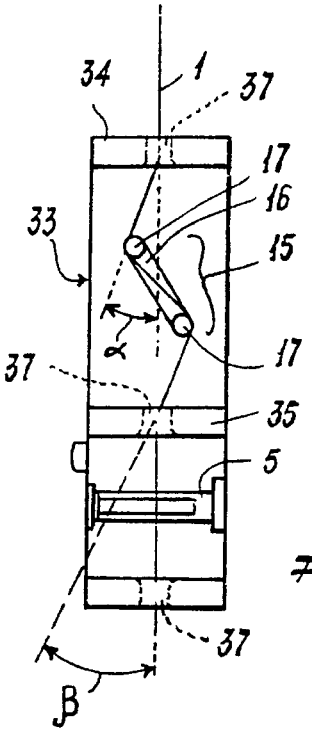
FIG. 3 is a front view of the device shown in FIG. 1.

In one embodiment of the device of the invention, shown in FIGS. 2 and 3, the braking member 15 is fork-shaped and comprises a support 16 from which two parallel arms 17 extend in a perpendicular direction from the support. The arms are formed of an anti-friction material (ceramic, alumina or the like) and cooperate directly with the yarn in such a manner that the yarn forms angles $\alpha$ and B to the direction from which it arrives from the bobbin 2 or to the direction in which it is fed to the machine T, respectively, which are varied by rotation of the support element in accordance with the desired tension for the yarn processed by the machine. For this purpose, (i.e., to vary the angles) the support 16 is associated with an output shaft 20 of an electrical and/or hydraulic and/or pneumatic and/or magnetic actuator, for example an electric motor 21 preferably of stepping type, the operation of which is controlled by the unit 6.

Figure 4:
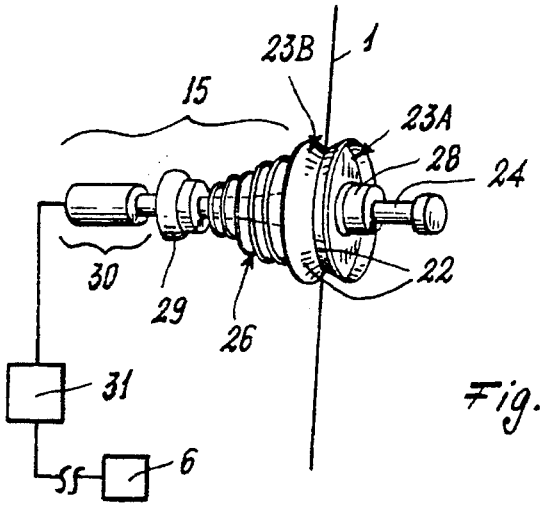
FIG. 4 is a different embodiment of part of the device shown in FIG. 1.

Alternatively, the member 15 could be one of a plurality of different constructions, one of which comprises two opposing discs 23A and 23B cooperating with the yarn with their frusto-conical portion 22 contacting each other, as shown in FIG. 4. The discs are mounted on a shaft 24 on which there is also mounted a compression spring 26. The disc 23A rests against a shoulder 28 whereas the disc 23B cooperates directly with the spring 26 and is urged thereby against the disc 23A so as to clamp the yarn between discs 23A and 23B and brake the movement of the yarn thereby varying the tension of the yarn. The spring 26A is subjected to the action of a pusher element 29 slidable along the shaft 24 by a hydraulic and/or pneumatic piston 30 fed and moved by an actuator member 31. The operation of actuator member 31 is controlled by the unit 6. By varying the thrust of the disc 23B against the disc 23A the tension in the yarn 1 can be varied by virtue of the variation in its braking.

As shown in FIGS. 2 and 3, the device of the invention comprises a one-piece body 33 containing the aforestated elements constituting the invention. Body 33 comprises arms 34, 35 and 36 having yarn guide holes 37 through which the yarn 1 slides. The body 33 can also be provided with a plurality of holes 37 and/or members 15 able to cooperate with a plurality of yarns fed to a knitting or hosiery machine. Alternatively, a plurality of bodies 33 (without a respective unit 6, interface 11 and display 10) cooperate with respective yarns 1 and with a single control unit 6 connected to the interface and to the display.

Finally, the unit 6 cooperates with the textile machine to halt its operation whenever the sensor 5 senses a yarn tension greater or less than the desired value and which is outside the acceptable tolerance range (caused for example by a defect in the bobbin 2 or a hindrance of any kind to the free movement of the yarn), or a tension peak (caused, e.g., by the yarn being locked on the bobbin). This operation prevents breakage of the yarn 1 and enables a substantially uniform quality to be maintained for the article produced by the machine T.

The method of the invention will now be described in relation to the use of the aforesaid device.

A yarn 1 is fed to the machine T. To facilitate the initial movement of the yarn, the braking member 15 does not initially act on it (for example the discs 23A, 23B are spaced apart). By means of the sensor 5, the unit 6 detects whether the yarn is moving, e.g., by sensing a continuous tension variation (moment by moment). Using suitable algorithms, this detection enables the unit 6 to sense whether the yarn is moving. If however the unit does not sense instantaneous variations in the yarn tension it considers that the yarn is not moving and activates devices for halting the textile machine and/or warning devices (acoustic and/or light-emitting), not shown, to indicate the stoppage of the yarn and/or its absence and breakage or its undue movement. The device of the invention is therefore also able to detect whether the yarn fed to a textile machine is moving or not, and to advise the user of any abnormalities in the feed to the machine.

Alternatively, a movement sensor may be connected to the unit 6 to enable the unit 6 to determine whether the yarn is moving or not.

Having sensed that the yarn is moving, the unit 6 switches to the tension control stage. If this tension is different from the desired value, the member 15 is activated to vary its braking action on the yarn and return its tension to the desired value (preferably the average value of a range of predetermined measurements). The action of the member 15 terminates when the tension reaches the desired value. If the tension varies once again, the member 15 again operates under the control of the unit as previously described. In this manner, the tension is substantially constant for the entire duration of production by the machine T, the articles then possessing a reliable uniformity of quality.

The operation of the unit 6 (continuous during yarn feed to the machine T) will now be described in detail with reference to FIGS. 5 and 6, wherein blocks defining the operational stage of the unit 6 are marked by a reference numeral, by which they will be indicated.

Figure 5:
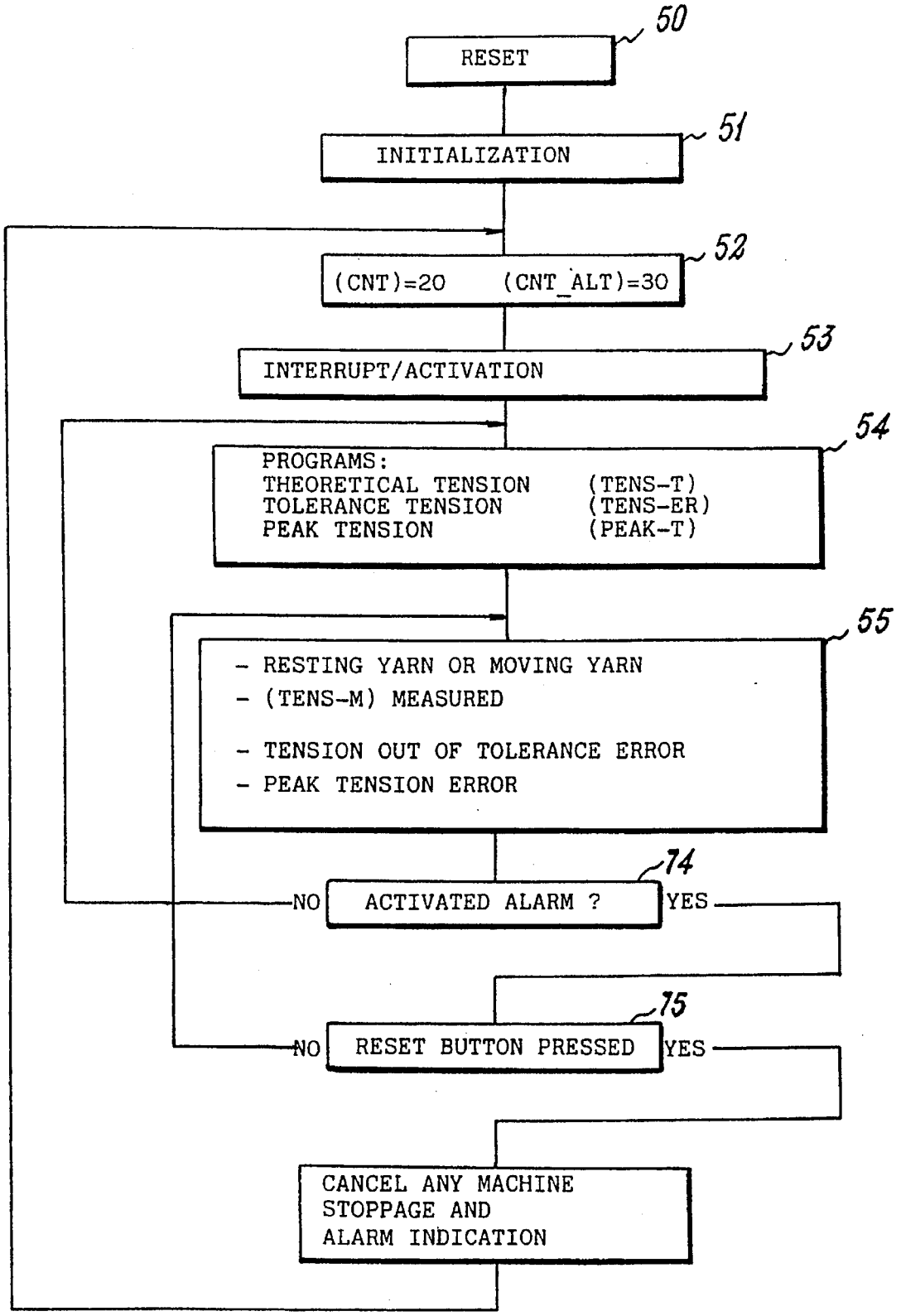
FIG. 5 shows the main flow diagram of the operations performed by the device implementing the method of the present invention.

With reference to FIG. 5, in a first stage 50 the unit 6 is reset and then initialized in stage 51, so arranging it for operation. The number of measurements (CNT) to be made for calculating an average tension with which to compare the instantaneous values measured during the use of the yarn is then defined (e.g., 20 measurements), together with the maximum number of attempted but unsuccessful adjustments (CNT ALT) when an instantaneous tension different from the desired tension is measured (e.g., 30 adjustments). This is represented by block or stage 52.

Figure 6:
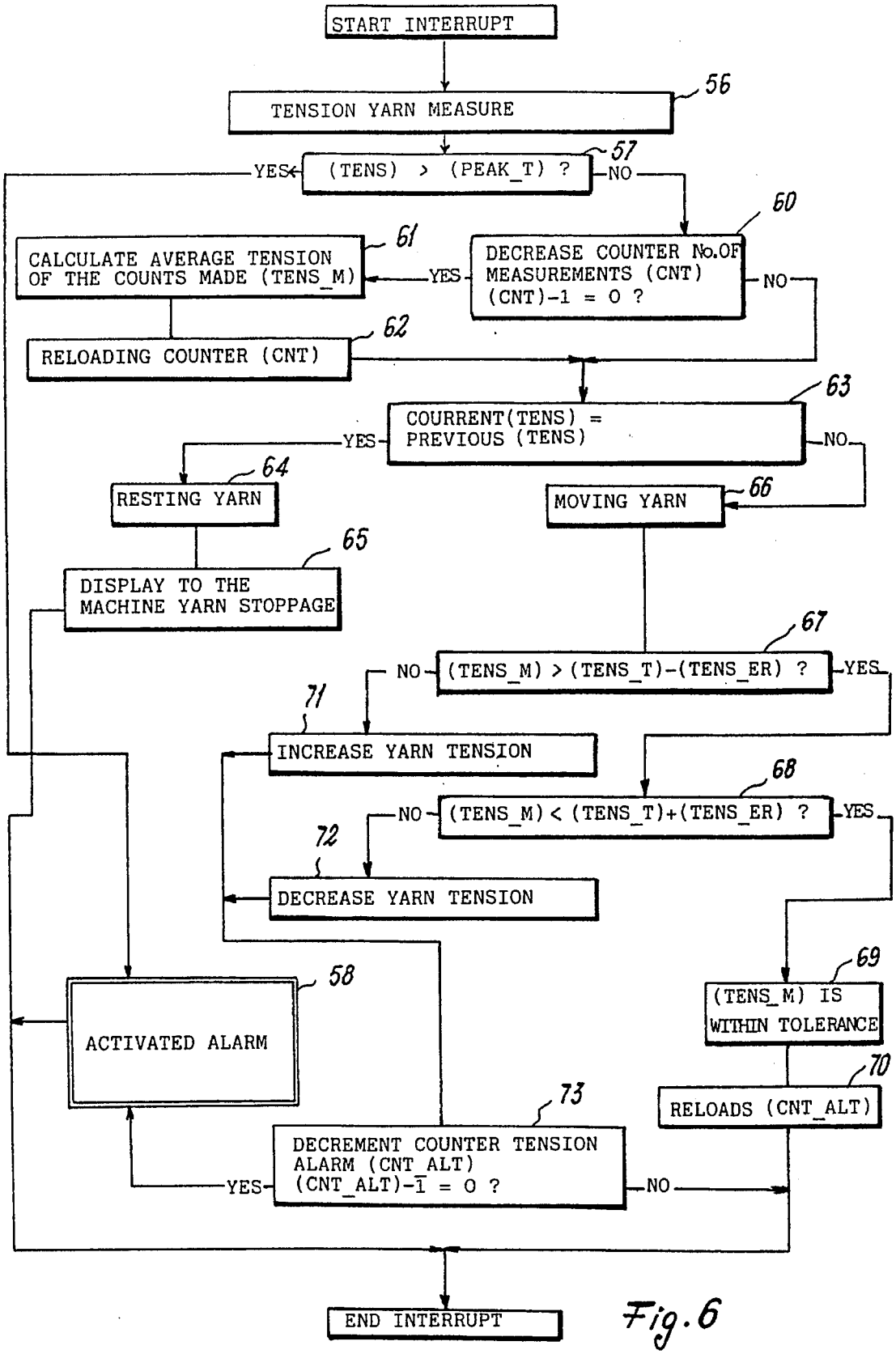
FIG. 6 shows the flow diagram of the interrupt routine of the main flow diagram shown in FIG. 5, which routine is effected at predetermined constant intervals.

The time interrupt routine (INTERRUPT) (block or stage 53) is then activated, resulting in the performance of the interrupt routine steps shown in FIG. 6, which are performed at predetermined constant intervals. In stage or block 54, the desired theoretical tension data (TENS-T), the tension tolerance (TENS-ER) and the peak tension (PEAK-T) are fed into the unit 6 via the interface 11 and memorized in the unit. In stage or block 55, the display is set to show, if there is no alarm, whether the yarn is at rest or moving and also the measured tension (TENS-M), or, in the case of an alarm, whether there is yarn breakage, tension out of tolerance or peak tension.

During performance of the interrupt routine (FIG. 6), the unit 6 receives in stage 56 the tension signals (TENS) from the sensor 5 and compares them with the memorized peak value (PEAK-T, stage 57). If the tension is greater than the peak tension, the unit 6 activates an alarm (block 58) and halts the machine. The unit 6 displays the stoppage (stage or block 55) on the display 10.

If the tension is not greater than the peak tension, the unit 6 calculates the average tension of the counts made (block 61), after decreasing the counter CNT (relative to the number of measurements made, block 60) to zero and then reloading it in block or stage 62 (as indicated in the relative blocks).

The calculation of the average is made only if in stage 60 the value of the counter CNT decreased by one at each measure equal to zero. Then following the steps of blocks 61 and 62 or of block 60 alone, the difference between the current tension and the previous tension is calculated (block 63). If these are equal, the yarn is considered at rest (block 64) and the unit 6 indicates "yarn stoppage" to the machine and displays it (block 55). If they are not equal, the unit 6 senses that the yarn is moving (block 66) and commences the actual tension adjustment stage (blocks 67-71-72).

During this stage, the unit 6 checks (blocks 67 and 68) whether the measured tension is within tolerance. If the measured tension is not within its tolerance, the unit 6 acts on the braking member 15 which brakes the yarn 1 to increase its tension (block 71) or slackens its action on the yarn (block 72).

If the tension is within tolerance, the unit 6 senses this (block 69) and reloads the counter relative to the number of adjustments attempted without success CNT ALT (block 70).

If adjustments have been made (blocks 71, 72) the counter CNT ALT is decreased by one (block 73) and if its value reaches zero after a member of consecutive adjustments the program returns to block 58 and the machine T is halted. If not, the unit terminates the interrupt routine and again operates in accordance with the flow diagram of FIG. 5 from the point at which it was interrupted.

It then checks if any alarm device has been activated (block 74 of FIG. 5) and whether a usual reset button has been pressed (block 75 of FIG. 5). If the reply is positive, the unit 6 cancels any machine stoppage and activated alarm indication and repeats the aforesaid measurement, adjustment and control cycle stages.

Consequently, if the desired tension cannot be maintained, the unit 6 halts the machine. If it can be maintained, then the machine continues to operate without interruption and the measured tensions are shown on the display 10.

In addition to the connections described in relation to FIG. 1, the unit 6 comprises connection points 90 and 91 for communication with a unit (not shown) for controlling the production functions of the machine T. Digital signals can be fed via these points to the unit 6 to increase and decrease at will and/or automatically, depending on processing requirements, the desired tension preset in the unit 6 via the interface 11. The unit 6 comprises a further connection point 92 for feeding analog signals (for example via a potentiometer) corresponding to the digital signals, to the unit 6. The parameters memorized in the unit 6 can be modified via the points 90, 91 or 92 in accordance with processing requirements, e.g., to obtain when producing socks or knitwork a narrowing of the product at desired points (such as the ankles and rib of socks), so enabling the shape of the article produced to be modelled at will.

In the case of yarn-working textile machines operating on more than one yarn, the tension of the various yarns can be regulated simultaneously via the points 90, 91 and 92 (for example with the unit connected to the points 90 and 91), so avoiding having to adjust the tension of each yarn.

The device of the invention enables yarn tension (or braking) to be regulated without having to be maintained or cleaned, in that as the device adjusts the yarn tension on the basis of a measured value, it can never be influenced by any dirt accumulation in the braking member 15 (which in the case of normal disc-type yarn brakes causes them to open and hence no longer able to effect controlled braking).

The examples provided above are not meant to be exclusive. Many other variations of the present invention would be obvious to those skilled in the art, and are contemplated to be within the scope of the appended claims.

I claim:

1. A method for monitoring tension of a yarn unwound from a support bobbin and fed to a textile machine and for maintaining the tension of the yarn substantially constant and equal to a predetermined tension value, comprising the steps of:

determining whether the yarn is moving between the bobbin and the textile machine at a position between the bobbin and the textile machine, directing the yarn in a path from the bobbin to the textile machine over a tension sensor such that the yarn is in continuous engagement with the tension sensor, continuously measuring the tension of the yarn by maintaining the yarn in engagement with the tension sensor, the tension sensor generating a continuous electrical signal proportional to the tension of the yarn, said tension sensor selected from the group consisting of a piezoresistor and a foil strain gage, comparing the measured tension of the yarn to the predetermined tension value to detect whether there is a difference between the measured tension and a predetermined tension value, and adjusting the tension of the yarn at a position between the bobbin and the position in which the tension is measured if the measured tension is different than the predetermined tension value to cause the tension of the yarn to substantially equal the predetermined tension value.

2. The method of claim 1, wherein the step of determining whether the yarn is moving comprises ascertaining a variation in the measured tension of the yarn.

3. The method of claim 1, further comprising the steps of averaging a plurality of values of the measured tensions at different times and comparing the average tension to the predetermined tension value.

4. The method of claim 1, further comprising the steps of providing a preset peak tension for the yarn, comparing the measured tension to the preset peak tension, and adjusting the tension of the yarn on the basis of a difference between the measured tension and the preset peak tension value.

5. The method of claim 1, further comprising the step indicating and/or halting the textile machine when a difference is detected between the measured tension and the predetermined tension.

6. The method of claim 1, further comprising the steps of counting the number of consecutive detected differences between the measured tension and the predetermined tension value, and halting the textile machine when the number of consecutive detected differences equals a preset value.

7. The method of claim 1, further comprising the steps of counting the number of successive adjustments of the tension of the yarn, and halting the textile machine if the measured tension of the yarn after a predetermined number of successive adjustments does not equal the predetermined tension value.

8. The method of claim 1, further comprising the step of displaying the measured tension and predetermined tension value.

9. A device for monitoring tension of a yarn unwound from a support bobbin and fed to a textile machine and for maintaining the tension of the yarn substantially constant and equal to a predetermined tension, comprising sensor means for sensing movement of at least one yarn and for continuously measuring tension of said at least one yarn during movement of said at least one yarn, said sensor means selected from the group consisting of a piezoresistor and a foil strain gage, guide means for maintaining said at least one yarn in continuous engagement with said sensor means during movement of said at least one yarn, said sensor means generating a continuous electrical signal proportional to the tension of said at least one yarn, comparison means coupled to said sensor means for determining a difference between the measured tension and a predetermined tension, control means coupled to said comparison means, and braking means coupled to said control means for adjusting the tension of said at least one yarn as a function of said difference between the measured tension and the predetermined tension determined by said comparison means to cause the tension of said at least one yarn to substantially equal the predetermined tension.

10. The device of claim 9, wherein said sensor means are positioned between the bobbin and the to,tile machine and consist of a single sensor.

11. The device of claim 9, wherein said comparison means and said control means constitute a single control unit.

12. The device of claim 11, wherein said control unit is connected to the textile machine and controls stoppage of the textile machine on the basis of said difference between the measured tension and the predetermined tension, the device further comprising acoustic and/or visual indication means connected to said control unit.

13. The device of claim 11, wherein said sensor means comprise tension measuring units and said control unit is connected to a plurality of said tension measuring units, each of said plurality of tension measuring units cooperating with a corresponding yarn being fed to the textile machine.

14. The device of claim 11, wherein said control unit comprises means for controlling the operation and production of the textile machine.

15. The device of claim 9, wherein said braking means comprise a fork-shaped element having a support element, arms connected to said support element, an actuator having an output shaft for transferring motive force, said output shaft being connected to said support element, said actuator being coupled to said control means.

16. The device of claim 15, wherein said actuator is selected from the group consisting of an electrical actuator, a hydraulic actuator, a pneumatic actuator, a magnetic actuator, an electric motor.

17. The device of claim 9, further comprising display means coupled to said control means for displaying the measured instantaneous tension, and an input interface connected to said control means.

18. The device of claim 9, wherein said sensor means and said braking means are arranged on a single one-piece body, said guide means comprising a yarn guide for directing said at least one yarn towards said sensor means and said braking means.

19. The device of claim 15, wherein said arms project in a perpendicular direction from said support element, said at least one yarn being passed between said arms such that upon rotation of said support elements, the tension of said at least one yarn varies.

20. The device of claim 9, wherein said braking means comprise first and second opposing discs, a shaft passing through said discs, a shoulder arranged on one end of said shaft and against which said first disc rests, a compression spring arranged on said shaft to press said second disc against said first disc to thereby clamp said at least one yarn between said first and second discs and adjust the tension of said at least one yarn.

21. The device of claim 20, wherein said braking means further comprise an actuator member coupled to said control means, and a pusher element slidable along said shaft in contact with said spring, said actuator member moving said pusher element to vary the compression of said spring.

* * * * *